United States Patent [19]

Van Erden

[11] Patent Number: 4,912,616

[45] Date of Patent: Mar. 27, 1990

[54] BAG WITH INFOLD ALONG FLANGE FOR DIFFERENTIAL OPENING FORCE

[75] Inventor: Donald L. Van Erden, Wildwood, Ill.

[73] Assignee: Minigrip, Inc., Orangeburg, N.Y.

[21] Appl. No.: 368,090

[22] Filed: Jun. 19, 1989

Related U.S. Application Data

[63] Continuation of Ser. No. 182,095, Apr. 15, 1988, abandoned.

[51] Int. Cl.[4] ..... B65D 33/16

[52] U.S. Cl. ..... 383/65; 383/95; 383/903

[58] Field of Search ..... 383/63, 65, 95, 97, 383/903

[56] References Cited

U.S. PATENT DOCUMENTS

| | | | |
|---|---|---|---|
| 3,509,927 | 5/1970 | Hasty et al. | 383/63 X |
| 3,991,801 | 11/1976 | Ausnit | 383/65 X |
| 4,000,768 | 1/1977 | Siegel | 383/63 X |
| 4,191,230 | 4/1980 | Ausnit | 383/65 X |
| 4,528,224 | 7/1985 | Ausnit | 383/63 X |
| 4,682,366 | 7/1987 | Ausnit et al. | 383/65 |

*Primary Examiner*—Stephen Marcus
*Assistant Examiner*—Nova Stucker
*Attorney, Agent, or Firm*—Hill, Van Santen, Steadman & Simpson

[57] ABSTRACT

A bag structure and the method of forming wherein the bag is formed of a thin film material with wall panels and an openable bag top having pressure closable rib and groove profile fasteners at the top and upwardly extending pull flanges with a fold formed at the top of one of the wall panels and extending downwardly to attach to one of the fasteners and the flange of that fastener attached directly to the fastener so that the pull flange can apply an opening force directly to the fastener and so that the side wall and the fold can expand and move outwardly without applying a direct force to the fastener which would tend to open the fastener.

6 Claims, 3 Drawing Sheets

BAG WITH INFOLD ALONG FLANGE FOR DIFFERENTIAL OPENING FORCE

This is a continuation, of application Ser. No. 182,095 filed Apr. 15, 1988, now abandoned.

BACKGROUND OF THE INVENTION

The present invention relates to improvements in plastic film bags with pressure closable releasable rib and groove profile fasteners at the top.

In the development of thin plastic film bags, an objective to be served is to provide a bag which has pressure closable and reopenable continuous rib and groove profile fastener elements at the top. Such fastener elements must securely close the bag and resist accidental opening due to forces on the side walls of the bag which occur during stacking, handling and merchandising. In order to reduce the cost of the bag, the fastener profiles are made as lightweight as possible without jeopardizing the facility of the fasteners to hold the bag closed. The ability of the fastener to remain closed can be augmented by design of the fastener but also by design of the bag structure in relation to the fastener structure.

An object of the present invention is to provide an improved bag structure and method of making same wherein the bag has a reclosable fastener at the top and can withstand pulls and shocks from handling and from the contents without accidental opening of the bag fastener.

A further object of the invention is to provide an improved method of making a bag structure wherein the structure can be rapidly and easily fabricated without unnecessary and noneconomical time-consuming steps.

A further object of the invention is to provide an improved bag structure which has a greater resistance to opening.

Another object of the invention is to provide an improved method of making a flexible plastic bag having a reclosable fastener at the top wherein a unique handling and structuring of the bag material is employed so as to obtain a bag which opens more easily from the outside than from the inside.

FEATURES OF THE INVENTION

In accordance with the principles of the invention, a bag structure is provided formed of a thin plastic film wherein the bag has wall panels defining an openable bag top flanked by opposed upwardly projecting pull flanges at the upper end portions of the wall panels. Fastener structures at the top of the bag are preferably formed of pressure closable releasable rib and groove profile strips which may be integral with the wall panels or attached to the inner surface thereof. At least one wall panel is inwardly tucked at the upper portion to form a fold with the end of the fold extending downwardly and attached directly to the fastener. The pull flange for that fastener is also attached directly to the fastener with its lower portion sealed to the top of the fold so that opening forces applied to the pull flange will be applied directly to the fastener while the sealed fold at the top of the wall panel acting as a hinge will tend to insulate the fasteners from forces tending to separate them due to outward pressures on the wall panel caused by handling or due to contents contained within the bag. The inwardly tucked fold layers are held in their folded relationship by the side seams at the edges of the wall panels, with the upper fold being sealed to the lower part of the pull flange as indicated.

The wall panel when pushed outwardly, such as in handling or by the contents, transmits its force to a location above the center-line interlocked rib and groove profiles. This tends to pivot the profiles rather than applying an opening force so that the forces on the profiles act in the shear mode rather than the peel mode.

The bag is conveniently made in one form by extruding a continuous tube of plastic with profiles on the inner surface wherein the profiles are brought together and the film below one of the profile is doubled so that one inwardly tucked fold results. By sealing the top of said fold and by cross-sealing the tube to form the side seams of the wall panels, the inwardly tucked fold layers are held in position. Thus, a resultant structure is provided wherein the same film of one wall panel forms the inwardly tucked fold and forms the upwardly extending flange and yet the flange is directly connected to the fastener and the sealed fold provides a force insulation structure relative to the fastener and to the side wall panel.

Other objects, advantages and features will become more apparent with the teaching of the principles of the invention in connection with the disclosure of the preferred embodiments thereof in the specification, claims and drawings, in which:

DESCRIPTION OF THE PREFERRED EMBODIMENTS

Figure 1:
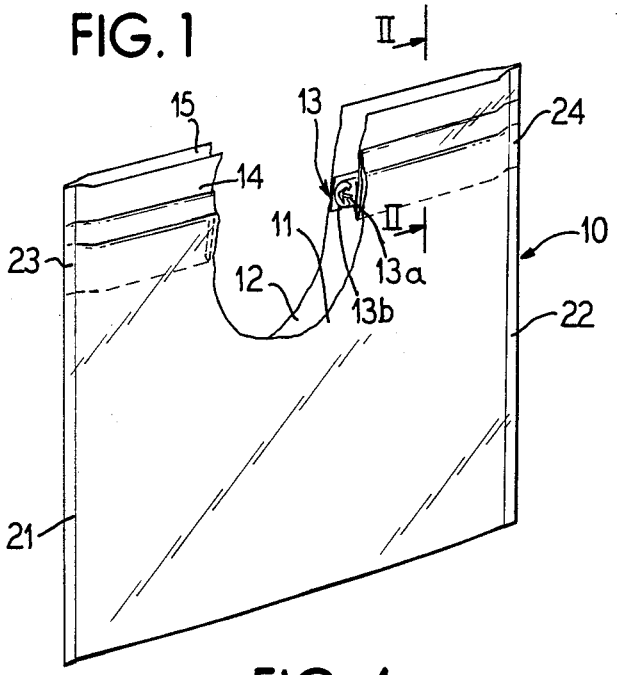
FIG. 1 is a perspective view with portions broken away of a bag constructed in accordance with the principles of the present invention.
Figure 2:
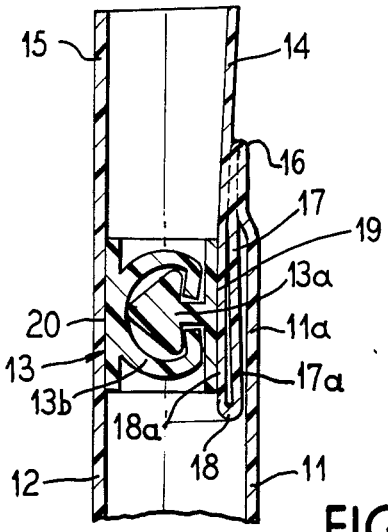
FIG. 2 is an enlarged fragmentary vertical sectional view taken substantially along line II—II of FIG. 1.
Figure 3:
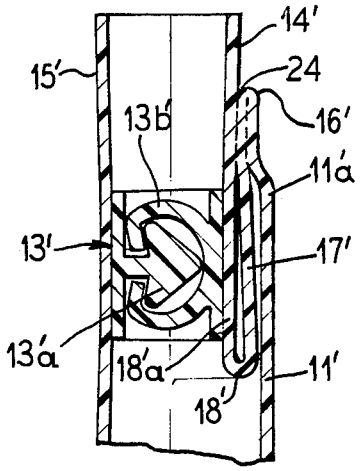
FIG. 3 is an enlarged fragmentary view similar to FIG. 2, but illustrating another form of construction wherein the tucked hinge arrangement of FIG. 2 is applied to the other wall panel, that is, to the panel opposite the groove profile rather than opposite the rib profile.

As illustrated in FIGS. 1 through 3, a bag structure 10 is formed of a thin plastic film such as polyethylene or similar material or of laminated materials having front and back wall panels 11 and 12. The panels have an openable bag top above which extends opposed upwardly projecting pull flanges 14 and 15. At the bag top is a fastener structure 13 which has pressure closable releasable rib and groove profile fasteners 13*a* and 13*b*. 13*a* represents a rib structure which is releasably received by a groove structure 13*b* when the profiles are pressed together. By pulling the flanges 14 and 15 laterally apart, the rib and groove profile fasteners will separate to afford access to the interior and the contents of the bag.

The pressure closable profile fasteners are illustrated as being of separate strips which are attached to the inner surface of the panels 11 and 12 by heat sealing or by an adhesive, being attached at 19 and 20. In another form, the profile fasteners may be integral with the plastic film of the panels as will be described in connection with a form of making the structure in FIGS. 4 and 5, and also FIGS. 6 and 7 which illustrate another method.

The panels 11 and 12 are joined at their lower edge, such as by being doubled, and are joined at their side edges by seams 21 and 22. The seams may be formed by heat sealing which joins the panels at their edges to form a product containable bag.

At the top edge of a least one of the panels, as illustrated by the panel 11, the panel is formed with an inwardly tucked fold folded at 16 having the fold portion 17 extending downwardly and doubled back at 18 and the upwardly extending upfold portion 18*a* attached to the fastener 13*a*. The upfold portion 18*a* continues on upwardly to provide the pull flange 14. The downfold 17 essentially forms a hinge at its top edge 16 where it is sealed to the bottom of the flange 14. This allows the wall panel 11 to bulge outwardly without exerting a direct pull on the fastener 13. In other words, the hinge at the top edge 16 is located above the centerline of the interlocking rib element 13*a* and groove element 13*b*. If handling forces, such as occur in filling the bag and in storing or merchandising it, push outwardly on the panel 11, the upper end of the panel can first move away from the fastener without exerting an outward opening force thereon. Thus, if forces occur on the bag due to bulging contents, they are assimilated or absorbed by the inwardly tucked fold 17 so that the bag can be handled or thrown or dropped without forcing the rib and groove elements 13*a* and 3*b* to separate. A severe pull or force on the panel 18 will tend to pivot the fastener 13 causing it to absorb forces in the shear mode rather than the peel mode. In the shear mode, the rib and groove fastener 13 is strongly resistant to opening, whereas in the peel mode, the rib and groove elements can be pulled apart for opening the bag.

A feature of the structure is that the inwardly tucked fold is formed conveniently of the material of the side panel 11 merely by folding it downwardly and then upwardly. A convenient construction and a preferred arrangement is such that the material is again turned upwardly in the upfold 18*a* to form the flange 4. Because the fastener 13*a* is directly attached to the inner surface of the flange 14, pulling the flange 14 outwardly will exert a direct opening force on the fastener 13*a*, i.e., in the peel mode.

In other words, the flange 14 is directly connected to the fastener portion 13*a* whereas the side panel is connected to the fastener only through the inwardly tucked top sealed fold 17, and at a location above the centerline of the rib and groove elements.

In the past, other means of providing the force differential between the inside and outside of a bag have been used. For example several forms of fastener construction accommodate this and are known to those versed in the art, one form being to form the arrowhead fastener with a difference in angles at the base of the arrowhead and/or a difference in length of projections at the base of the arrowhead. Different fastener structures are known which provide for easier opening from the outside of the bag than from the inside. While a preferred form of rib and groove structure is shown, other forms may be employed.

The side seams 21 and 22 of the bag conveniently hold the inwardly, i.e., the downwardly and again upwardly tucked fold layers in place at the bag sides.

When the side seams 21 and 22 are formed after the folds are made in the side panel 11, the folds are clamped in their relative position at locations 23 and 24 as shown in FIG. 1. Since the side seams 21 and 22 are essentially heat welds, they clamp and join the layers in their relative position and, of course, also hold the rib and groove elements in alignment at the edges of the bag so that the bag can be easily closed by a progressive pressure across the top of the bag such as by pulling the bag between the thumb and forefinger.

FIG. 3 illustrates a form of the bag similar to FIG. 2, but where the fold is utilized on the side panel which has the groove element. The fastener is shown at 13' having groove element 13*b'* and rib element 13*a'*. The side panel is shown at 11' with its top portion 11*a'* folded at 16' to form a downfold portion 17'. The downfold portion is reversed at 18' to have an upfold portion 18*a'* which extends upwardly to form the upper opening flange 14'. The opposing opening flange is shown at 15' extending above the rib element 13*a'*. The downfold portion 17' and the upfold portion 18*a'* are secured such as by heat welding to the base of the groove element so as to provide an upper hinge portion 16' which is located above the center-line of the rib and groove elements 13*a'* and 13*b'*. The structure will operate much the same as the arrangement shown in FIG. 2 so that when the side wall panel 11 is pushed outwardly, it will tend to pivot at the upper edge 16' so as to effect a shear force on the fastener 13' rather than a peel force.

Figure 4:
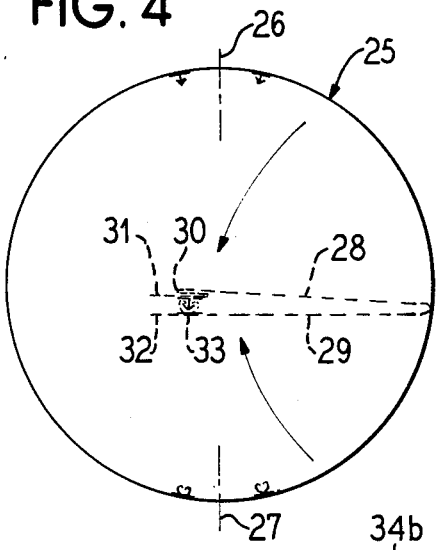
FIG. 4 is a somewhat schematic sectional view taken through a tube of film illustrating the manner in which two bags may be formed of a single tubular extrusion.
Figure 5:
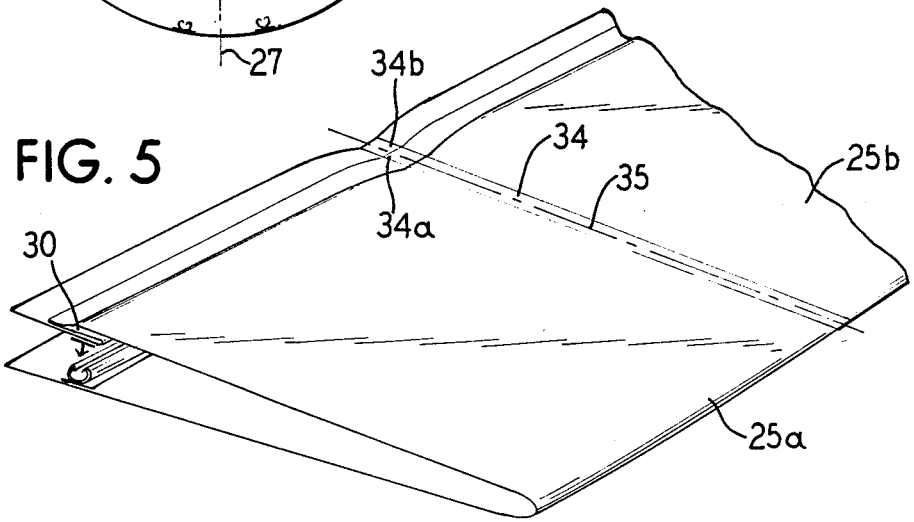
FIG. 5 is a fragmentary perspective view illustrating the manner of making cross seams to form individual bags.

FIGS. 4 and 5 show a form wherein the rib and groove profile fastener elements are integral with the film of the bag. FIG. 4 shows a continuous extruded plastic film tube 25 having fastener profile elements on the inner surface. The tube of FIG. 4 has four profile elements therein, but it will be understood that tubes with more profiles may be employed or tubes with only two opposing profiles may be used. In the arrangement of FIG. 4 after the tube 25 is formed, longitudinally extending cuts are made at 26 and 27 to sever the film. The portions of the film at the side of the cuts are then brought together in the direction of the arrowed lines to the dotted line position of FIG. 4 with side panels of a bag shown at 28 and 29. The rib and groove profile elements are shown at 33. Flanges extend above the profiles as shown at 31 and 32. An inwardly tucked fold is provided at 30 being first turned downwardly to have a downwardly extending portion and then turned upwardly with the upwardly extending portion continuing on upwardly to provide the flange 31. The downwardly extending portion continuing on from the location 30 and the upwardly extending portion are both welded to the base of the rib element so that the side wall panel 28 is hinged at the location 30 having the same arrangement as illustrated in the detail of FIGS. 2 and 3.

As illustrated in FIG. 5, with the structure folded in the manner shown in FIG. 4, the continuous strip of folded film is cross-sealed at 34. The cross-seal is shown in FIG. 5 at 34 joining the edges of adjacent bags 25*a* and 25*b*. The seal is severed along a severance line 35 down the center to separate the bags. The bags can also be severed as they are sealed. As will be noted at 34*a* and 34*b*, the seal has joined the layers of the fold 30 at the upper edge of the side panel of the bag. A seal 36 is also provided attaching the top of the fold 30 to the bottom of the flange 31.

Figure 6:
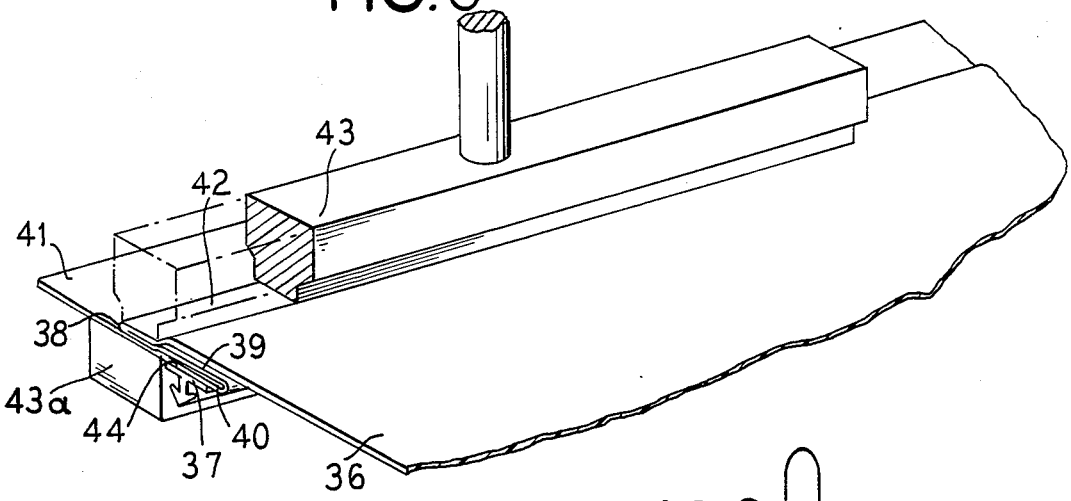
FIG. 6 is a perspective view with portions broken away illustrating the manner of making a longitudinal seal attaching the top of the downwardly facing fold to the opening flange.

Sealing of the side panel film to the base of the fastener profile may be performed in two steps. In a first step, the upfold portion 18*a* may first be sealed to the base of the profile 13*a* as shown in FIG. 2. In the next step, the downfold portion 17 may be sealed to the upfold portion 18*a* so that both portions 18*a* and 17 are then attached to the base of the profile 13*a*. This may be accomplished by applying heat to the outer surface of 18*a* before the fold 17 is laid over it, or by applying heat to the outer surface 17*a* after the fold is made at 18 and with the panel folded outwardly to allow access to the outer surface of the portion 17. The attachment may also be accomplished by applying a freshly hot extruded strip 13*a* to the folded portions of the bag while keeping the outer portion 18*a* separate from the downfold portion 17 with the heat of the freshly extruded profile joining it to the layer. Another manner of forming the attachment is to utilize an adhesive which will bond the profile 13*a* to the surface of the upfold portion 18*a* and a layer of adhesive which bond the downfold portion 17 to the outer surface of the upfold portion 18*a*. FIG. 6 illustrates another manner of making the bond, as described below.

While FIGS. 2 and 3 respectively illustrate structures wherein an inwardly tucked fold at the top edge of one of the panels is utilized, it may be desirable to provide this structure for both panels. That is, the infolded panels of both FIGS. 2 and 3 may be employed, one on the rib element side and one on the groove element side of the bag.

Figure 7:
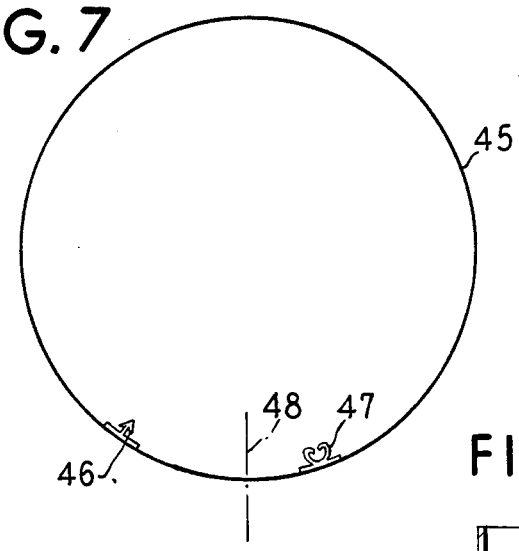
FIG. 7 is a sectional view taken through a plastic tub of material extruded in a form convenient for making a bag in accordance with the principles of the invention illustrating one profile on the inner surface of the tube and the other profile on the outer surface.
Figure 8:
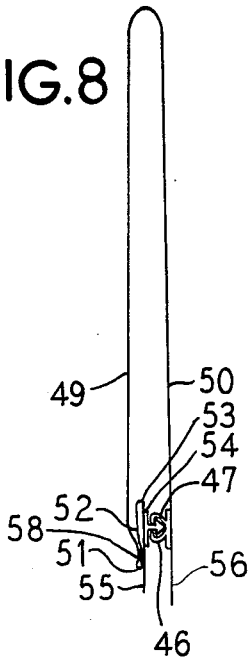
FIG. 8 is a vertical sectional view taken through the same tubular material as in FIG. 7, but illustrating the manner in which the plastic film of FIG. 7 will be handled and folded to form bags in accordance with the invention.

In operation, the bag is formed either with the fastener strips 13*a* and 13*b* attached to the inner surface of the wall panels 11 and 12, as shown in FIGS. 1 through 3 or integral therewith as shown in FIGS. 7 and 8. In either case, at least one wall panel such as 11 is formed with an inwardly tucked fold at the upper distal edge 16, or 16' or 30 of the wall with a downwardly extending portion which is then reverse folded to extend upwardly and be attached to the fastener with the upwardly extending portion forming the pull flange.

FIG. 6 illustrates a simplified manner in which a seal can be made to secure the reverse folds at the top of a wall panel. The wall panel 36 is folded downwardly at its top edge 38 to form a downfold 39 which is again reversed to form an upfold 40 which continues on upward to provide a pull flange 41. Secured to the inner surface of the upfold at 44 is a profile element. The profile element may be secured to this upfold portion 40 of the film by an adhesive or by thermal plastic attachment. A single heat seal is formed in the area 42 joining the top edge of the wall panel 36 to the upper edge of the downfold 39 and to the base of the flange 41. This can occur by applying a heat bar such as 43 which may be in the form of a reciprocating heat bar or a heated wheel with the fold of the film supported by an anvil 43*a*. In this arrangement, the downfold 39 is arranged to be high enough so that the seal 42 can be formed above the profile element 37. In this structure, the pull flange 41, when the bag is to be opened, can be pulled outwardly and a peeling or separating force will be transmitted to the profile element 37. The side wall panel 36, if forced outwardly such as by the contents of the bag, will pivot at the base of the heat seal area 42 which is located above the centerline of the profile element 37. Thus, forces on the side panel 37 will not tend to open the bag, but will cause it to operate in the shear mode rather than the peel mode. Thus, the bag will be more easily opened from the outside than from the inside.

Figure 9:
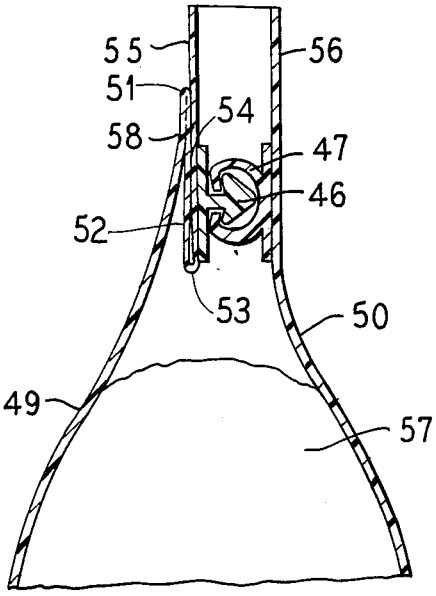
FIG. 9 is a vertical sectional view taken through a filled bag illustrating the effect of the contents on the bag side wall panels.

FIGS. 7, 8 and 9 illustrate a very direct and simplified manner of forming bags wherein the bags are formed by a single extruded tube 45. The tube of a thin plastic film has both profiles i.e., a the male profile 46 on the outer surface and a female profile shown at 47, on the inner surface. For use, the tube is cut at 48 and folded in the manner shown in FIG. 8. This forms one wall panel 49 and an opposing wall panel 50. It will also be apparent that tubes can be formed to make two or more bags with other similarly positioned profiles at spaced locations.

In folding the bag of FIGS. 8 and 9, the wall panel 49 is folded at 51 to form a downfold 52 and again folded at 53 to form an upfold 54. The upfold continues to form one of the pull flanges at 55. The fastener profile 46 is on the upfold portion 54. A bond is formed in the area 58 joining the downfold 52 to the lower part of the pull flange 55. The side wall panel 49 then pivots at the fold location 51 if the panel 49 is forced outwardly so that a direct peeling or separating force is not applied to the interlocked profiles 46 and 47.

As illustrated in FIG. 9, the contents in the bag will tend to spread or separate the side wall panels 49 and 50. This creates a pull directed toward the fastener profiles 46 and 47. The pull exerted by the wall panel 49 is applied at point 58 which is above the center-line of the fastener profile so as to tend to tip the profile. If the side wall 49 is continued to be pushed outwardly, the fastener profiles will tip to be pulled in line with the two panels 49 and 50 rather than be peeled apart.

Figure 10:
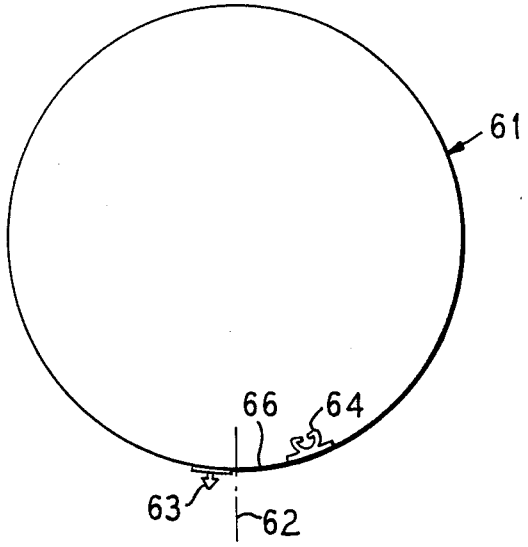
FIG. 10 is a somewhat schematic sectional view taken through a tube of film illustrating another manner in which the film may be manufactured and the profiles located on the film surface.

FIG. 10 illustrates an elongate continuous plastic film tube 61 with profiles 63 and 64 on the surface. The profiles are shaped to be interlocking and one of the profiles is on the inner surface of the film tube and the other on the outer surface.

Figure 11:
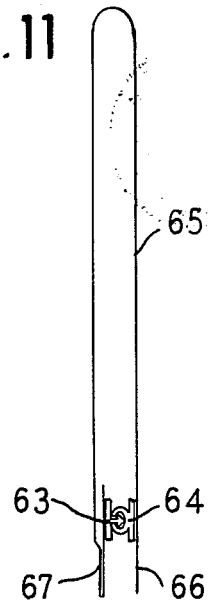
FIG. 11 is a somewhat schematic vertical sectional view taken through a bag formed from the tubular film of FIG. 10.

For forming a bag 65, such as shown in FIG. 11, the tube is cut at 62 between the profiles leaving a longer length 66 which will eventually become the pull flange as shown in FIG. 11. The other pull flange is formed by folding the film in the manner illustrated in FIG. 11, doubling the film at 67 back on itself and attaching the faces of the doubled film at 67. These faces may be attached with adhesive or preferably are heat welded and the doubled layer of film 67 forms the other pull flange. What is significant is that the attachment of the film to itself at the doubled layer 67 exists above the center-line of profiles 63, 64. Thus, when the side panels of the bag are forced apart, the stress on the arrowhead profile 63 is above its center-line so that the profiles will tip and the forces which tend to open the bag are shear forces rather than peel forces. That is, the interlocked profiles tend to tip so that pulls on the profiles are parallel to the film. The pulls are cross-wise of the interlocked profiles rather than in the direction of their interlocking so that the pulls have a far lesser tendency to separate the profiles thus providing a more firmly interlocked bag top.

Figure 12:
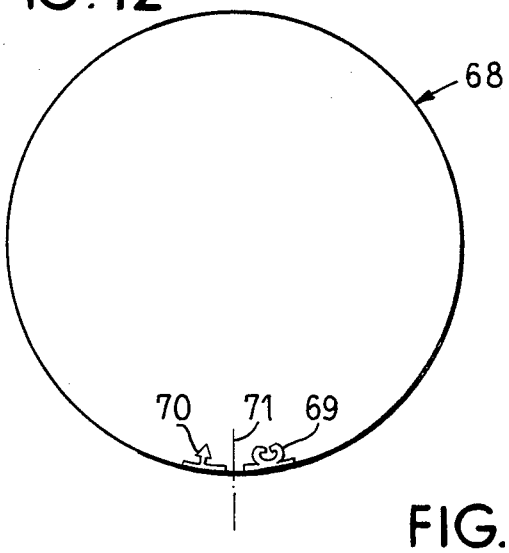
FIG. 12 is a somewhat schematic vertical cross-sectional view taken through a tubular length of film illustrating another arrangement of the profiles on the film surface.

FIG. 12 illustrates another form of extruded plastic tube 68 with interlocking profiles 69 and 70 on the inner surface thereof. For forming the bag, the bag is cut between the profiles at 71.

Figure 13:
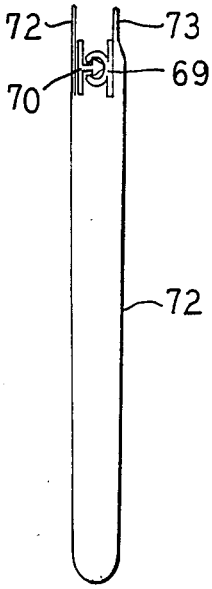
FIG. 13 is a sectional view taken through a bag formed of the film tube of FIG. 12.

The resultant bag is shown in FIG. 13 herein the bag body 72 is formed by the film. The profiles 69 and 70 are interlocked and the film is doubled at each side of the profiles to form a doubled upwardly extending pull flange for each side with the pull flanges shown at 72 and 73. The faces of the doubled portions 72 and 73 are bonded to each other such as by heat sealing so that the bonded portion is above the center-line of the interlocked profiles.

When the side walls of the bag tend to bulge outwardly, they a point at the base of the bonded faces of theflanges 72 and 73. This pivotal point is above the center-line of the interlocked profiles so that stresses on the profiles are in the shear mode rather than the peel mode.

Figure 14:
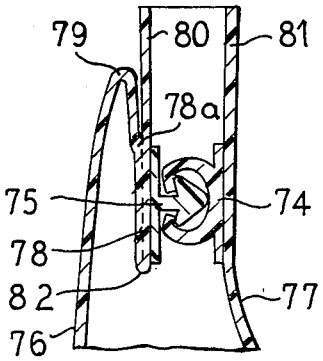
FIG. 14 is a fragmentary enlarged sectional view taken through the top of a bag illustrating the fastener profiles and the manner in which the film is folded and attached to obtain the advantages of the present invention.

FIG. 14 illustrates another manner in which the plastic film adjacent the fastener profiles may be folded and arranged. For the structure of FIG. 14, a tubular film such as that shown in FIG. 4 may be employed wherein the film is severed with pull flanges 80 and 81 of essentially equal length extending above interlocking profiles 74 and 75. One panel 77 of the bag extends straight upwardly. The other panel 76 is folded at 79 in a downwardly extending fold and again folded upwardly at 82 in an upwardly extending fold. The faces of the downwardly extending fold and upwardly extending fold are bonded to each other along a line 78 opposite the interlocking profile 75. The bond extends upwardly to a location **78*a* above the center-line of the profile so that as the side panel 76 of the bag is forced outwardly, the side panel can move outwardly flexing the fold 79 and any pull stresses on the profiles are exerted at 78*a* above the profiles. Thus, the profiles tend to tilt or tip so that forces on the interlocked profiles are in the shear mode rather than the peel mode and this results in a stronger interconnection between the rib and groove profiles. When the bag is to be opened, the pull flanges 80 and 81** are pulled apart and separating peel forces are transmitted directly to the profiles so that the bag opens more easily from the outside than from the inside.

As illustrated in FIG. 2, in summary, the bag structure has side panels 11 and 12 formed of thin plastic film and define as openable bag top with upwardly extending flanges 14 and 15. The first panel 11 is turned downwardly in a fold at 16 to form a downwardly extending first portion 17. The panel 11 and first portion are attached to each other at a bond at 16 which may be in the form of a heat weld. The first portion is turned upwardly again at 18 to form a second portion **18*a* to which the fastener structure 13 is attached, namely the rib element 13*a*, with the groove element 13*b* attached to the other panel 12. The second portion 18*a* extends upwardly to form a pull flange 14 which is attached at the bond 16 to form a second bond joining the panel to the pull flange above the center line of the fastener structure. This permits the first panel 11 to pivot at the bond 16 above the profile fasteners converting forces on the side panels 11 and 12** which are transmitted to the profiles to act on the profiles in a shear mode rather than a peel mode.

Thus, it will be seen that I have provided an improved bag construction and method of making which is simplified and can be utilized with either separate profile fastener strips or with integral fastener profile strips. There has been provided an improved bag structure and method of making which meets the objectives and advantages above st forth and provides a structure which is attractive in appearance and which functionally will withstand stresses and strain caused by contents and handling superior to bags which are more easily opened by accidental shocking and jarring.

I claim as my invention:

1. A bag structure having a thin film material body providing a side wall panels defining an openable bag top flanked by opposing upwardly projecting pull flanges on upper end portions of the wall panels, the bag structure comprising:

first and second opposed side wall film panels with the upper end of the first panel turned downwardly in a first fold to provide a downwardly extending first portion;

a fastener structure at the top of the bag including opposed pressure closable releasable rib and groove profile fasteners attached between the panels;

the first folded portion and the first panel attached in a bond at the top of the fold;

said fastener structure attached below said bond so that the first panel pivots at the bond above the profiles converting forces on the side panels which are transmitted to the profile fasteners to act on the fasteners in a shear mode rather than a peel mode.

2. A bag structure having a thin film material body providing the side wall panels defining an openable bag top flanked by opposing upwardly projecting pull flanges in upper end portions of the wall panels, the bag structure constructed in accordance with claim 1:

wherein said profile fasteners are integral with the material of the side wall film panels.

3. A bag structure having a thin film material body providing the side wall panels defining an openable bag top flanked by opposing upwardly projecting pull flanges in upper end portions of the wall panels, the bag structure constructed in accordance with the claim 1:

wherein said bond is a heat weld.

4. A bag structure having a thin film material body providing the side wall panels defining an openable bag top flanked by opposing upwardly projecting pull flanges in upper end portions of the wall panels, the bag structure constructed in accordance with claim 1:

wherein said first panel is again folded upwardly from the lower edge of said first portion to form a second portion and the fastener structure is secured to said second portion.

5. A bag structure having a thin film material body providing the side wall panels defining an openable bag top flanked by opposing upwardly projecting pull flanges in upper end portions of the wall panels the bag structure constructed in accordance with claim 4.

wherein said second portion extends upwardly from said fastener structure to provide an upwardly extending pull flange.

6. A bag structure having a thin film material body providing the side wall panels defining an openable bag top flanked by opposing upwardly projecting pull flanges in upper end portions of the wall panels, the bag structure constructed in accordance with claim 5;

wherein the pull flange is attached to said bond by a second bond.

* * * * *